United States Patent [19]

Hagiwara et al.

[11] Patent Number: 4,664,321

[45] Date of Patent: May 12, 1987

[54] SHELL STRUCTURE OF HEAVY-LOAD TYPE ROD MILL

[75] Inventors: Tatsuo Hagiwara, Funabashi; Keiji Imai, Ibaraki; Shigenori Nagaoka, Chiba; Shinji Kogumazaka, Funabashi; Kyoichi Yahagi, Matsudo; Takeshi Imagawa, Ibaraki; Hidenaga Ishii, Tokyo; Toshitsugu Kikuchi, Takasaki, all of Japan

[73] Assignees: Kawasaki Jukogyo Kabushiki Kaisha, Kobe; Ishii Syoji, Ltd., Tokyo, both of Japan

[21] Appl. No.: 738,182

[22] Filed: May 28, 1985

[30] Foreign Application Priority Data

Jun. 1, 1984 [JP] Japan ..... 59-112539

[51] Int. Cl.[4] ..... B02C 17/18

[52] U.S. Cl. ..... 241/176; 241/180; 241/299

[58] Field of Search ..... 241/170–184, 241/299, 300

[56] References Cited

U.S. PATENT DOCUMENTS 1,161,859 11/1915 Hardinge ..... 241/179 X

FOREIGN PATENT DOCUMENTS 57-27571 6/1982 Japan .

450281 7/1936 United Kingdom ..... 241/179

OTHER PUBLICATIONS

"Handbook of Mineral Dressing", Taggart, John Wiley and Sons, Inc., New York, 1927, p. 40.

*Primary Examiner*—Mark Rosenbaum

*Attorney, Agent, or Firm*—Leydig, Voit & Mayer

[57] ABSTRACT

A shell structure of a heavy-load type rod mill including a barrel having an outlet port and with a plate thickness of $t_1$, and a pair of trunnions having journals integrally formed thereon and with a plate thickness of $t_2$, which trunnions are welded to the barrel. At the weld joining the barrel and the trunnion, the relationship between the plate thickness $t_1$ of the barrel and the plate thickness $t_2$ of the trunnion is $t_1 \leqq t_2 \leqq 2t_1$.

10 Claims, 2 Drawing Figures

SHELL STRUCTURE OF HEAVY-LOAD TYPE ROD MILL

BACKGROUND OF THE INVENTION

1. FIELD OF THE INVENTION

This invention relates to the shell structure of a heavy-load type rod mill used for pulverizing material which subjects the rod mill to a very heavy load, and more particularly to the shell structure of a rod mill which uses a large rod. 2.

DESCRIPTION OF THE RELATED ART

In crushing and pulverising material which subjects a rod mill to an extremely heavy load, such as slag produced in an ironworks, a heavy-load type rod mill is employed which uses large rods in order to treat large lumps of metals which are included in the slag. In such a case, however, since the amount of material which can be treated in one cycle is very small as compared with the size of the rod mill, the rod mill is operated under very severe conditions such as a state in which an idle crushing phenomenon occurs, namely the phenomenon of a rod directly hitting against the barrel of the rod mill, or in which ground metals disturb the normal motion of the rods.

Conventionally, since the barrel of the rod mill and trunnions are connected by a flange fitting, stress is concentrated on the flange during operation of the rod mill and, sometimes, a bolt is broken or the joint comes loose. Sometimes, stress is concentrated on the weld where the fitting flange is welded to the barrel, resulting in the generation of cracks in the weld. At other times, stress is concentrated on the position where a manhole is provided in the barrel to enable access when the liner is to be replaced, and cracking is produced in the manhole fitting position.

SUMMARY OF THE INVENTION

Accordingly it is an object of the invention to solve the above-described problem and to provide a heavy-load type rod mill which can pulverize material without concentrating local stress on the shell structure and which is efficient in resistance to shock.

To this end, in a heavy-load type rod mill according to the invention, a barrel, trunnions and journal portions are integrally constructed and the relationship between the plate thickness $t_1$ of the barrel and the plate thickness $t_2$ of the trunnion at the welded portion of the barrel and the trunnion is $t_1 \leqq t_2 \leqq 2t_1$. Further, this rod mill dispenses with the need for a manhole by making the outlet of the rod mill large enough for replacement of the liner.

A heavy-load type rod mill according to the invention is advantageous in the following features:

(a) Since a rod mill according to the invention has a structure in which the barrel, trunnions and journals are integrally constructed, it is efficient in resistance to shock.

(b) The barrel is welded orthogonally to the trunnions, the plate thickness of the trunnion is 1 to 2 times that of the barrel, and the barrel has no manhole fitting position where stress is apt to be concentrated. In this way, local concentration of stress on the shell structure is precluded.

(c) Accordingly, material which subjects the rod mill to an extremely heavy load can be safely pulverized without any trouble.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1:
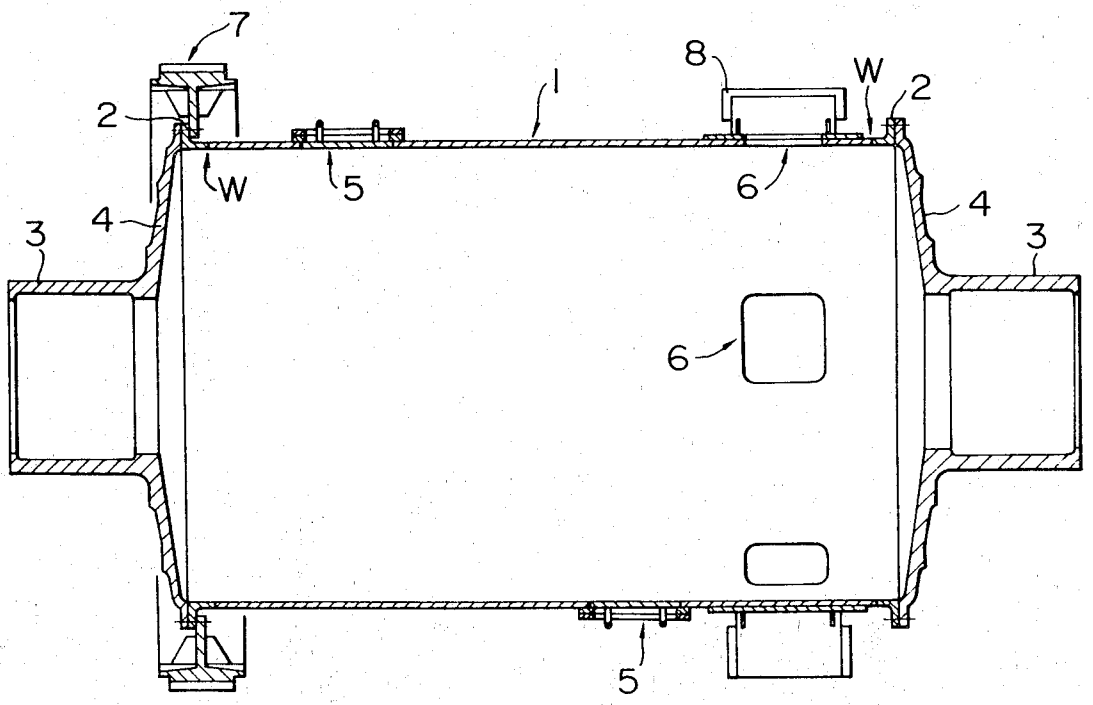
FIG. 1 PRIOR ART
FIG. 1 is a longitudinal sectional view of the shell structure of a rod mill in the related art.

Referring first to FIG. 1, the shell structure of a rod mill in the related art will be briefly explained.

To the flanges 2 of a barrel 1 are bolted by nuts and bolts the peripheral portions of trunnions 4 on which journals 3 are integrally formed. At appropriate positions of the outer peripheral wall of the barrel 1 are provided manholes 5 through which a liner is replaced, and on the outer peripheral wall at one end of the barrel is provided an outlet port 6. The reference numeral 7 denotes a rod mill rolling gear which is bolted together to the flange of the barrel 1 and the peripheral portion of the trunnion 4 by the nuts and bolts, and the reference numeral 8 represents a cover of the outlet port 6.

When material which places an extremely heavy load on a rod mill, such as slag produced in an ironworks, is pulverized by this rod mill, stress is concentrated on the portions where the flanges 2 of the barrel 1 and the peripheral portions of the trunnion 4 are bolted, resulting in breaking of bolts or loosening of the bolted portion. Alternatively, cracking is produced by concentration of stress on the weld W of the barrel 1 and the flange 2. Furthermore, cracking is apt to be produced on the manhole fitting positions by virtue of concentration of stress thereon.

Figure 2:
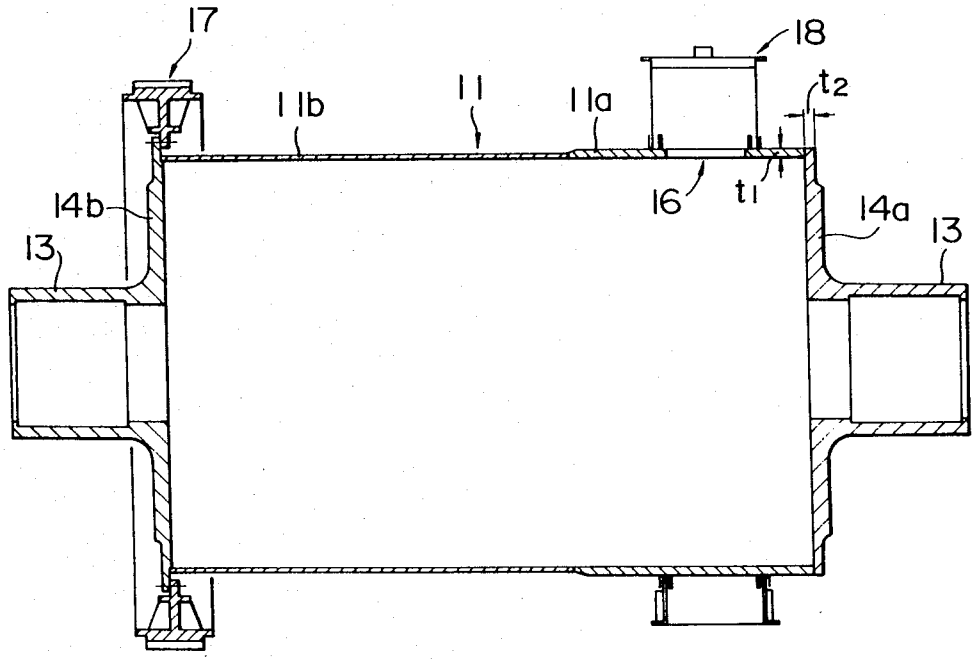
FIG. 2 is a longitudinal sectional view of the shell structure of an embodiment of a heavy-load type rod mill according to the invention.

An embodiment of a shell structure of a heavyload rod mill according to the invention will be explained with reference to FIG. 2.

A barrel 11 has no flanges on either end and at one end of the barrel 11 (at the left end in the Figure) a trunnion **14*b*, which has a larger diameter than the barrel 11 and on which a journal 13 is integrally formed, is welded concentrically and integrally to the barrel 11. On the peripheral portion of the trunnion 14*b* is concentrically bolted by bolts and nuts a rod mill rolling gear 17. At the other end (at the right end in the Figure) of the barrel 11, a trunnion 14*a* having the same diameter as the barrel 11 and having a journal 13 integrally formed thereon is welded concentrically and integrally to the barrel 11. On the peripheral wall of the barrel 11 at the opposite end to the end where the rod mill rolling gear 17 is fixed is provided an outlet port 16 which is of such a size as to be large enough for removing or inserting a liner (not shown) with which the inner surface of the trunnion 14*a*, 14*b* is lined. Thus, the barrel 11 is provided with no manhole. The top of the cover 18 for the outlet port 16** can be opened.

The plate thickness of the barrel 11 at the portion **11*a* where the outlet port 16 is provided is made larger than that at the other portion 11*b*, and at the weld joining the portion 11*a* and the trunnion 14*a* the plate thickness $t_1$ of the barrel 11 and the plate thickness $t_2$ of the trunnion 14*a*** are made to have the following relationship:

$t_1 \leqq t_2 \leqq 2t_1$

When material to be pulverized which places an extremely heavy load on a rod mill, such as ironworks slag, is charged into a rod mill and crushed and pulverized in the rod mill, the mill is operated under very severe conditions, for example, in a state where a rod, which is a medium for pulverizing large lumps, directly strikes against the barrel 11, which phenomenon is called "idle crushing", or in a state where ground metals disturb the normal motion of the rods, because the amount of the slag to be treated in the rod mill is small in comparison with the inner volume of the rod mill. The heavy-load type rod mill according to the invention, however, has the above-described structure in which the barrel 11, trunnions 14*a*, 14*b*, and the journals 13, 13 are integrally constructed by welding, and thus it is superior in resistance to shock, eliminating any risk of the joints of the barrel and the trunnions becoming loose, which phenomenon might often occur in the prior art. Further, since the weld of the end portion 11*a* of the barrel 11 having the outlet port 16 and the trunnion 14*a*, where stress is apt to be concentrated, is provided with sufficient strength by making the plate thickness $t_1$ of the end portion 11*a* of the barrel 11 and the plate thickness $t_2$ of the trunnion 14*a* have the following relationship:

$t_1 \leqq t_2 \leqq 2t_1$ and stress is transferred to the trunnion 14*a* side, there is no probability of crack generation at the weld joining the end portion 11*a* of the barrel and the trunnion 14*a*. In addition, since the barrel has no manhole which has conventionally been used for removing and inserting a liner and hence no manhole fitting position on which stress might be concentrated in the prior art, the strength of the barrel 11 is heightened.

While there has been described what is at present considered to be a preferred embodiment of the invention, it will be understood that various modifications may be made therein, and it is intended that the appended claims cover all such modifications as fall within the true spirit and scope of the invention.

What is claimed is:

1. A shell structure of a heavy-load type rod mill comprising:

a barrel having an outlet port and a plate thickness $t_1$, where said outlet port is provided, which is greater than in the remaining portions of the barrel; and a pair of trunnions formed integrally with journals and having a plate thickness $t_2$, which trunnions are welded to said barrel;

a relationship between said plate thickness $t_1$ of said barrel where said outlet port is provided and said plate thickness $t_2$ of said trunnion at a weld joining said barrel and said trunnion being $t_1 \leqq t_2 \leqq 2t_1$.

2. A shell structure according to claim 1, in which said outlet port is made large enough for replacement of a liner, which is provided on an inside of said shell structure, to take place through said outlet port, whereby said barrel is not required to be provided with a manhole exclusively for the purpose of replacing said liner.

3. A shell structure according to claim 2, in which a diameter of one of said pair of trunnions is made larger than that of said barrel, and a rod mill rolling gear is directly attached to one of said pair of trunnions.

4. A shell structure according to claim 1, in which a fixed annular cover which conforms to said outlet port and which covers a circumference of said barrel is provided, a bottom of said annular cover being open and a top thereof being openable.

5. A shell structure according to claim 1 wherein said barrel is free of manholes.

6. A shell structure accoridng to claim 1 wherein said outlet port is provided adjacent an end of said barrel.

7. A shell structure according to claim 1 wherein said portion of said barrel having a greater thickness corresponds to an end of said barrel having a thickness $t_1$ and the portion of the trunnion welded thereto has a thickness $t_2$.

8. A shell structure according to claim 7 wherein the trunnion having a thickness $t_2$ has substantially the same diameter as the end of said barrel to which it is welded.

9. A shell structure according to claim 1 wherein said barrel is substantially cylindrical.

10. A shell structure according to claim 1 wherein said trunnions are welded to said barrel with corner joints.

* * * * *